US009010314B2

(12) United States Patent
Rehage et al.

(10) Patent No.: US 9,010,314 B2
(45) Date of Patent: Apr. 21, 2015

(54) PULL-OUT DEVICE

(75) Inventors: Daniel Rehage, Bielefeld (DE); Daniel Reidt, Herford (DE); Sven Budde, Lübbecke (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 891 days.

(21) Appl. No.: 13/254,491

(22) PCT Filed: Mar. 4, 2010

(86) PCT No.: PCT/EP2010/052783

§ 371 (c)(1),
(2), (4) Date: Nov. 15, 2011

(87) PCT Pub. No.: WO2010/102949

PCT Pub. Date: Sep. 16, 2010

(65) Prior Publication Data

US 2012/0090594 A1 Apr. 19, 2012

(30) Foreign Application Priority Data

Mar. 11, 2009 (DE) ..... 20 2009 001 961 U

(51) Int. Cl.
*F24C 15/16* (2006.01)

(52) U.S. Cl.
CPC ..... *F24C 15/168* (2013.01)

(58) Field of Classification Search
USPC ..... 126/339; 312/334.22, 334.12
See application file for complete search history.

(56) References Cited

U.S. PATENT DOCUMENTS

| | | | | |
|---|---|---|---|---|
| 2,671,004 | A * | 3/1954 | Chadwick et al. | 312/350 |
| 8,047,199 | B2 * | 11/2011 | Le et al. | 126/339 |
| 2008/0237166 | A1 * | 10/2008 | Williams et al. | 211/169.1 |
| 2009/0095279 | A1 * | 4/2009 | Ambrose et al. | 126/337 R |

FOREIGN PATENT DOCUMENTS

| | | |
|---|---|---|
| DE | 44 45 319 | 6/1996 |
| DE | 20 2005 020 025 | 6/2007 |
| EP | 0 443 329 | 8/1991 |
| EP | 1 158 185 | 11/2001 |
| EP | 1 970 633 | 9/2008 |
| WO | 2007/007414 | 1/2007 |
| WO | 2008/072868 | 6/2008 |

* cited by examiner

*Primary Examiner* — Avinash Savani
(74) *Attorney, Agent, or Firm* — Barnes & Thornburg LLP

(57) ABSTRACT

A pull-out device for a household appliance The pull-out device includes a side grid configured to be installed in an interior space of the household appliance and a plurality of horizontal rods each having a bent end section on opposite sides of the rod, the bent end sections being fixed on a vertical post of the side grid. Also included is a guide rail fixed on at least one of the rods by a fastening element and locking means configured to detachably fix a sliding rail that is movably supported on the guide rail in one or both of a retracted and an extended position.

20 Claims, 27 Drawing Sheets

Fig. 10
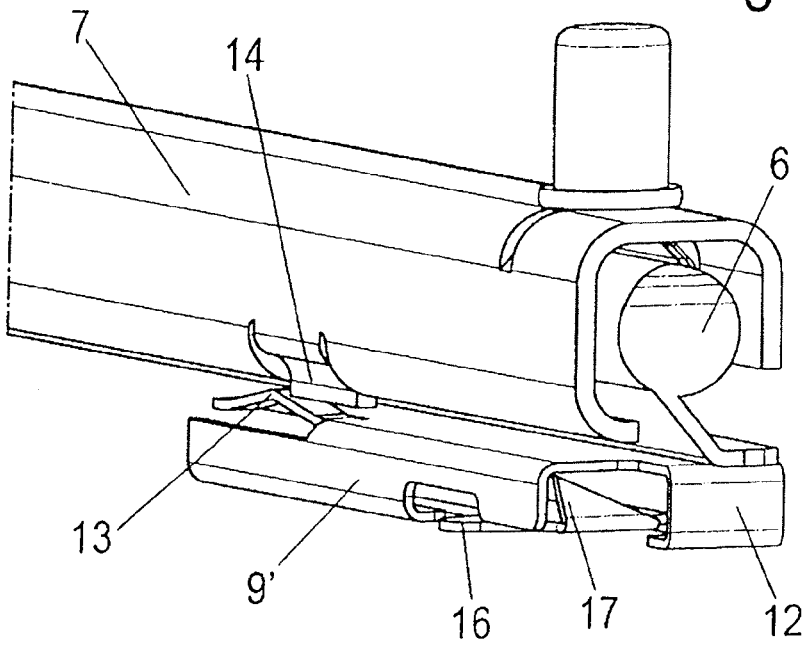
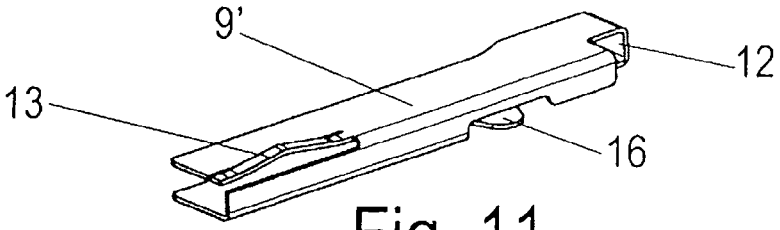
Fig. 11
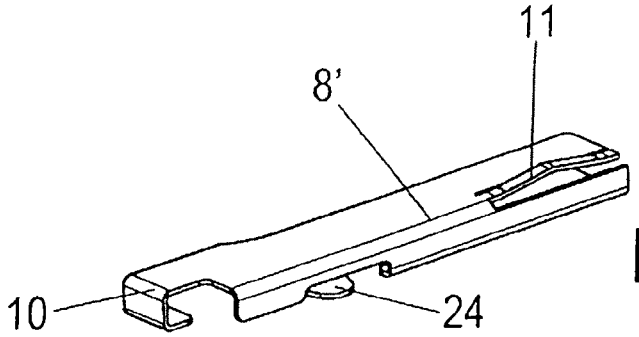
Fig. 12

Fig. 22
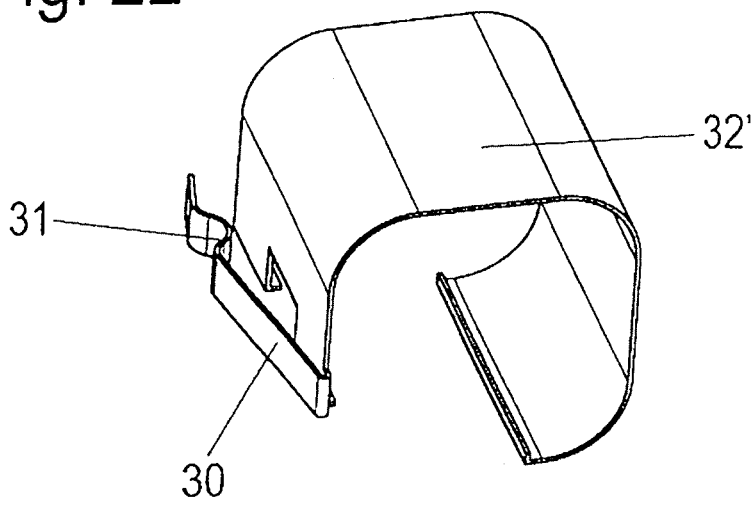
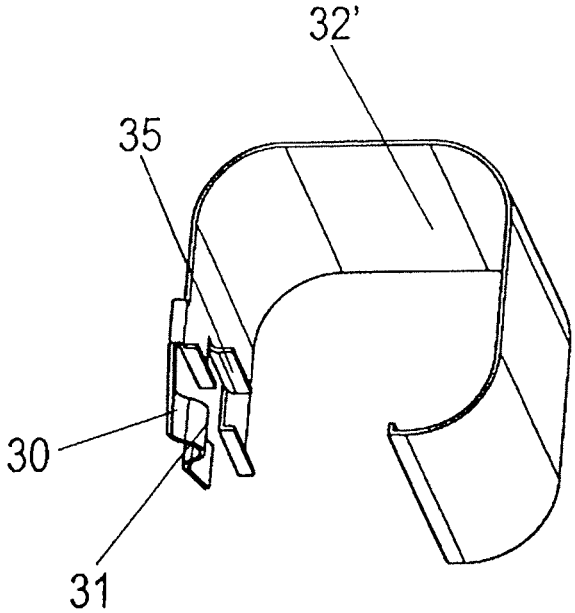
Fig. 23

PULL-OUT DEVICE

CROSS-REFERENCE TO RELATED APPLICATION

This application is a national stage of International Application PCT/EP2010/052783, filed Mar. 4, 2010, and claims benefit of and priority to German Patent Application No. 20 2009 001 961.6, filed Mar. 11, 2009, the content of which Applications are incorporated by reference herein.

The present disclosure relates to a pull-out device for a household appliance, such as a, baking oven. The pull-out device includes a side grid configured to be installed in an interior space of, for example, the baking oven. The device includes a plurality of horizontal rods which have a bent end section on opposite sides. The bent end sections are fixed on a vertical post. A guide rail of the pull-out device is fixed on at least one rod by fastening elements.

Known from EP 443 32'9 is a baking oven on which pull-out guides for a slide train are provided. A slot guide with a spring catch arrangement is provided in order to fix a food tray in a retracted position. This catch arrangement has a comparatively complex structure and is expensive to manufacture and assemble.

In order to facilitate the mounting of pull-out guides in a baking oven, it is known from WO 2007/07414 to fix a pull-out guide on a side grid by clip-like retaining sections. By this the pull-out guide can be pushed onto a horizontal rod of the side grid and fixed in a simple manner. However, if the pull-out guide is slightly inclined relative to the horizontal, an unintentional travel of a sliding rail can take place.

Embodiments of the present disclosure relate to a pull-out device which avoids any unintentional travel of a sliding rail and is easy to mount.

Thus, the present disclosure relates to a pull-out device for a household appliance. The pull-out device includes a side grid configured to be installed in an interior space of the household appliance and a plurality of horizontal rods each having a bent end section on opposite sides of the rod, the bent end sections being fixed on a vertical post of the side grid. Further included is a guide rail fixed on at least one of the rods by a fastening element and locking means configured to detachably fix a sliding rail that is movably supported on the guide rail in one or both of a retracted and an extended position.

According to the present disclosure, the pull-out device comprises fastening elements by which a guide rail of a pull-out guide can be fixed on a side grid. Furthermore, locking means are provided in order to detachably fix a sliding rail movably supported on the guide rail in a retracted and/or extended position. This ensures that the sliding rail, for example, upon loading with a food tray, can be fixed in a predetermined position so that a handling or another activity can be performed in a predetermined position of the sliding rail. The sliding rail of the pull-out guide is then moved again and the engagement is released. This considerably simplifies handling for the user since even with a slight inclination of the pull-out guide relative to the horizontal, an unintentional travel of the sliding rail is avoided in the engaged position. The engagement can be accomplished both in the retracted and in the extended position in order to allow a fixing in the end positions of the pull-out guide.

According to an embodiment of the present disclosure, the locking means includes an elastically deformable element which, for example, can include an elastic material or a spring element. In addition, it is within the scope of the present disclosure to configure the locking means with a resilient web in order to be able to make an engagement.

Furthermore, an element in the form of a locking projection can, within the scope of the present disclosure, be provided as locking means which projects from the sliding rail of a pull-out guide in the direction of the post of a side grid in order to produce a frictional contact between the respective post and the sliding rail in the locking zones.

Furthermore, a resilient web, for example, is provided as locking means, which is fixed on the sliding rail and in the event of a movement of the sliding rail, can be engaged both with a front vertical post and with a rear vertical post of the side grid. As a result, the stationarily disposed side grid can be used for engaging the sliding rail. The resilient web can, in accordance with the present disclosure, be formed integrally with the sliding rail or be fixed to the sliding rail by a clip or other fastening elements.

In a further embodiment of the present disclosure, the resilient web is formed integrally with one of the fastening elements for fixing the pull-out guide and cooperates with a projection, a profiling and/or a recess on the sliding rail. As a result, the fastening elements are configured to ensure a fastening of the pull-out guide, where the sliding rail is additionally engaged in one or more predetermined positions. The sliding rail may, according to the present disclosure, have a protruding web which cooperates with the locking means on the fastening elements.

In a further embodiment of the present disclosure, a resilient web is fixed on a vertical post. This web is configured to be fixed in a simple manner on the post by a clip and cooperate with a recess and/or profiling on the sliding rail for an engagement.

In a further embodiment of the present disclosure, a resilient web in the form of a locking element is fixed on a parallel-offset horizontal rod by a fastening element. A locking projection which cooperates with the resilient web is located on the sliding rail of a pull-out guide.

In a further embodiment of the present disclosure, a resilient web in the form of a resilient section is fixed on the wall of a household appliance or furniture. A locking projection which cooperates with the resilient web is located on the sliding rail of a pull-out guide.

Also only one locking position can, in accordance with the present disclosure, be provided in the retracted or extended position.

Other aspects of the present disclosure will become apparent from the following descriptions when considered in conjunction with the accompanying drawings.

BRIEF DESCRIPTION OF THE DRAWINGS

FIGS. 5 to 10 show several views of an embodiment of a pull-out guide for a pull-out device, in accordance with the present disclosure.

FIGS. 11 and 12 show two views of fastening elements of the pull-out device of FIG. 5.

FIGS. 22 and 23 show two views of a clip of the pull-out device of FIG. 21.

DETAILED DESCRIPTION

Figure 1:
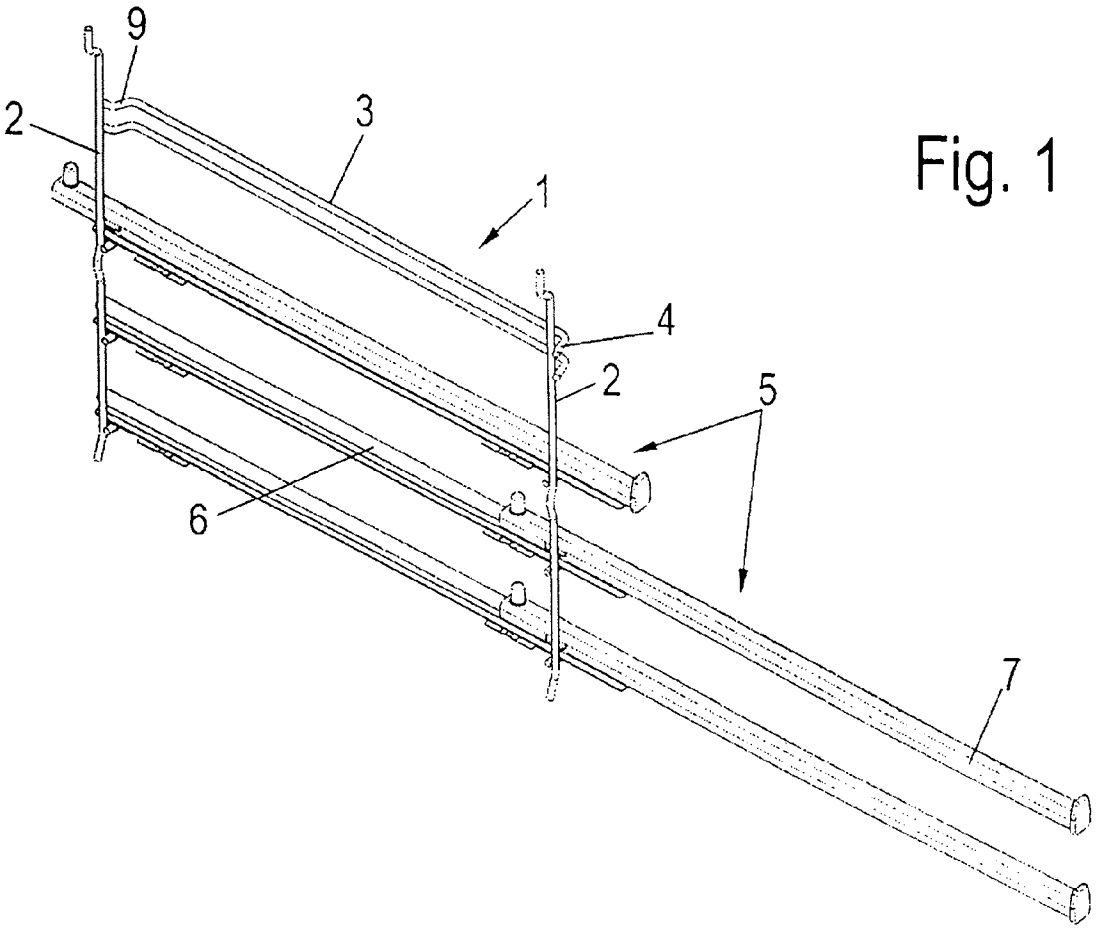
FIGS. 1 and 2 show two perspective views of an embodiment of a pull-out device, according to the present disclosure.
Figure 2:
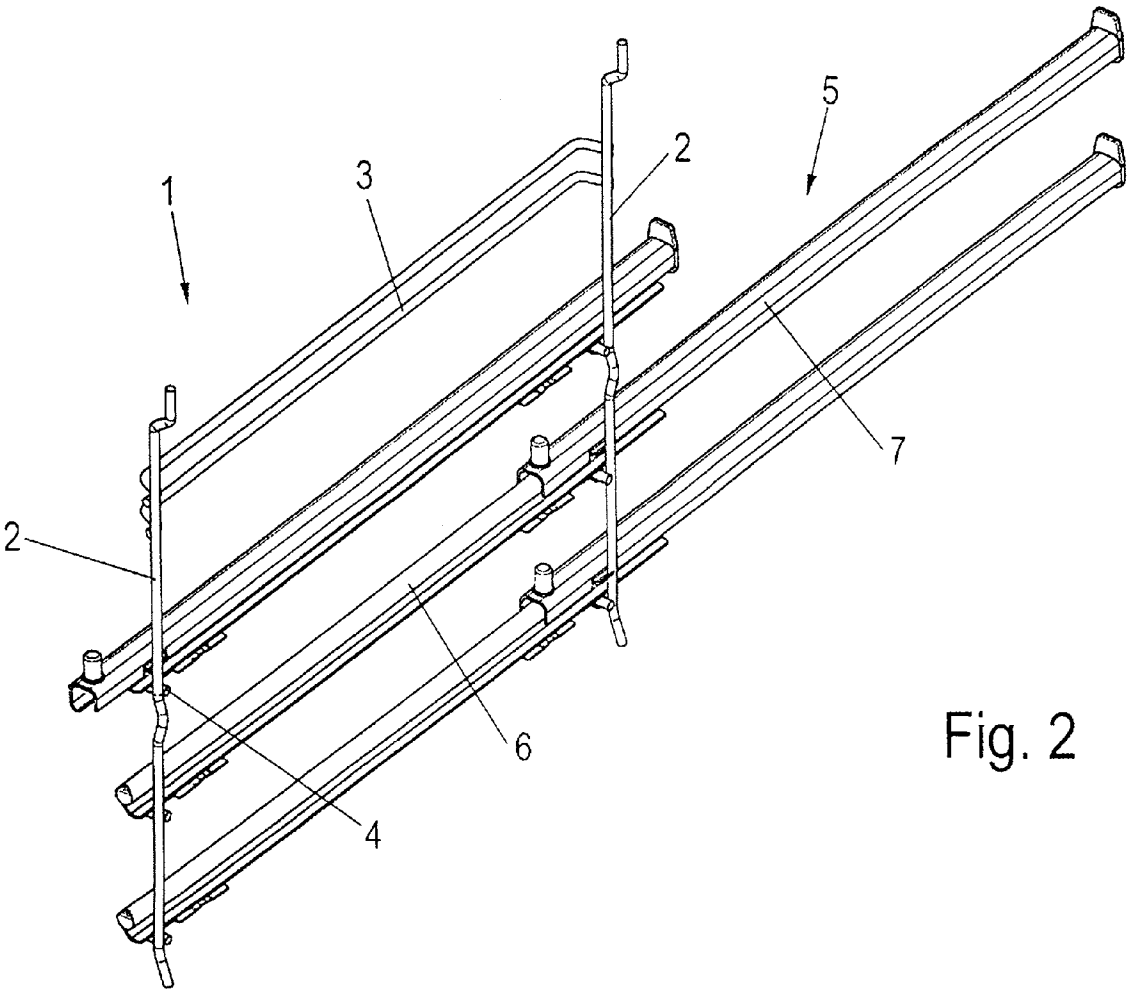
Figure 3:
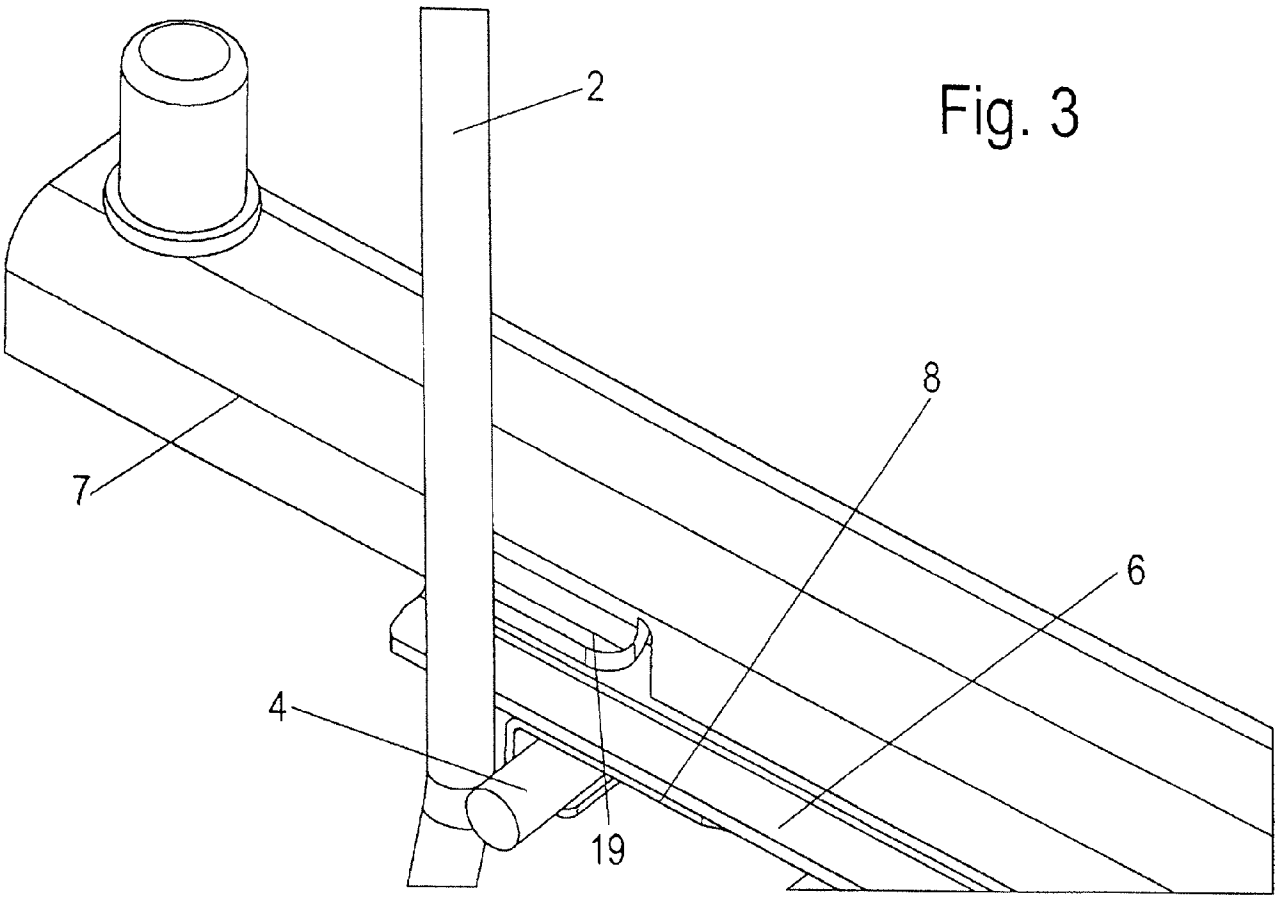
FIGS. 3 and 4 show two detailed views of the pull-out device of FIG. 1.
Figure 4:
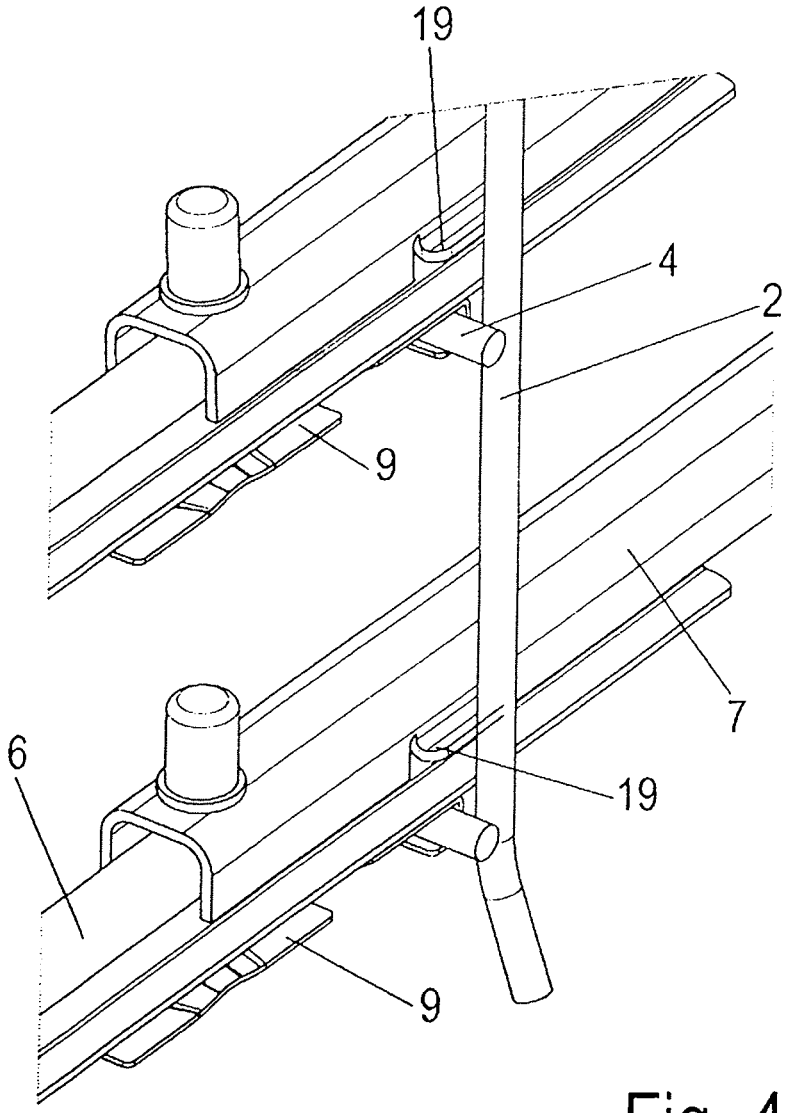
Figure 5:
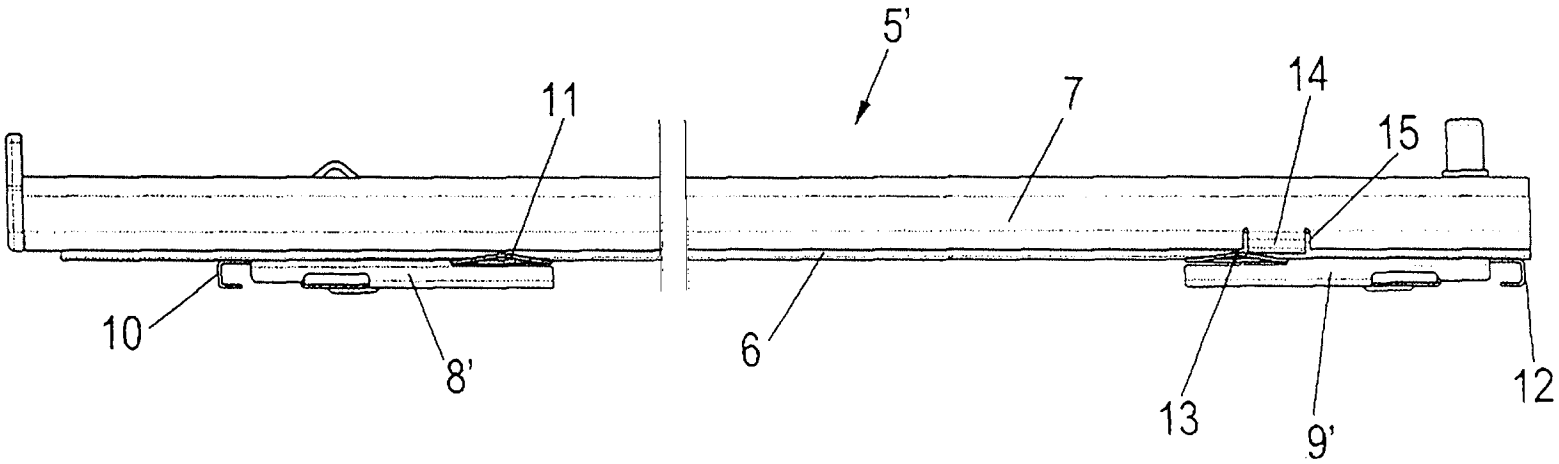
Figure 6:
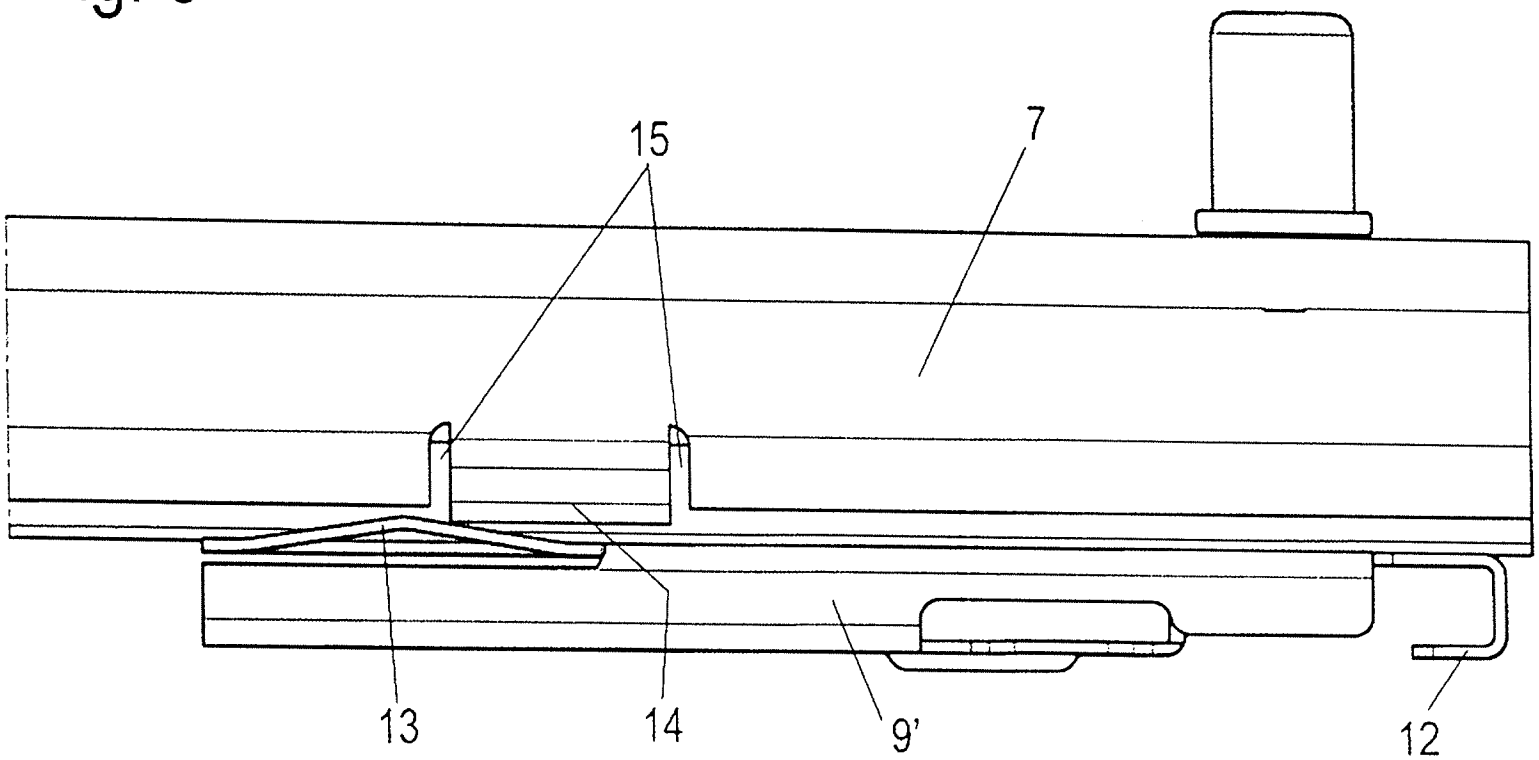
Figure 7:
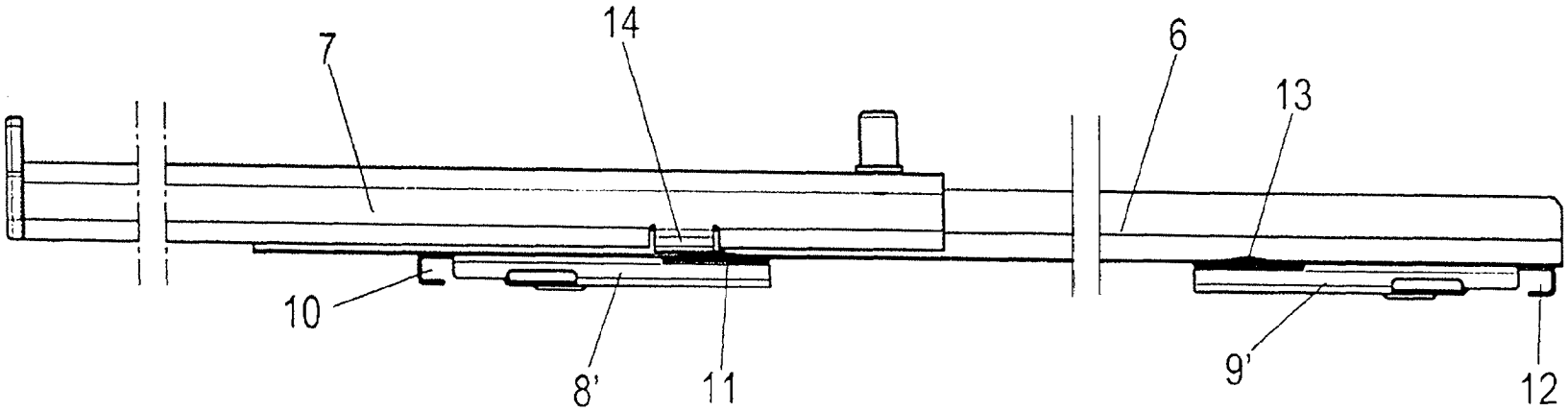
Figure 8:
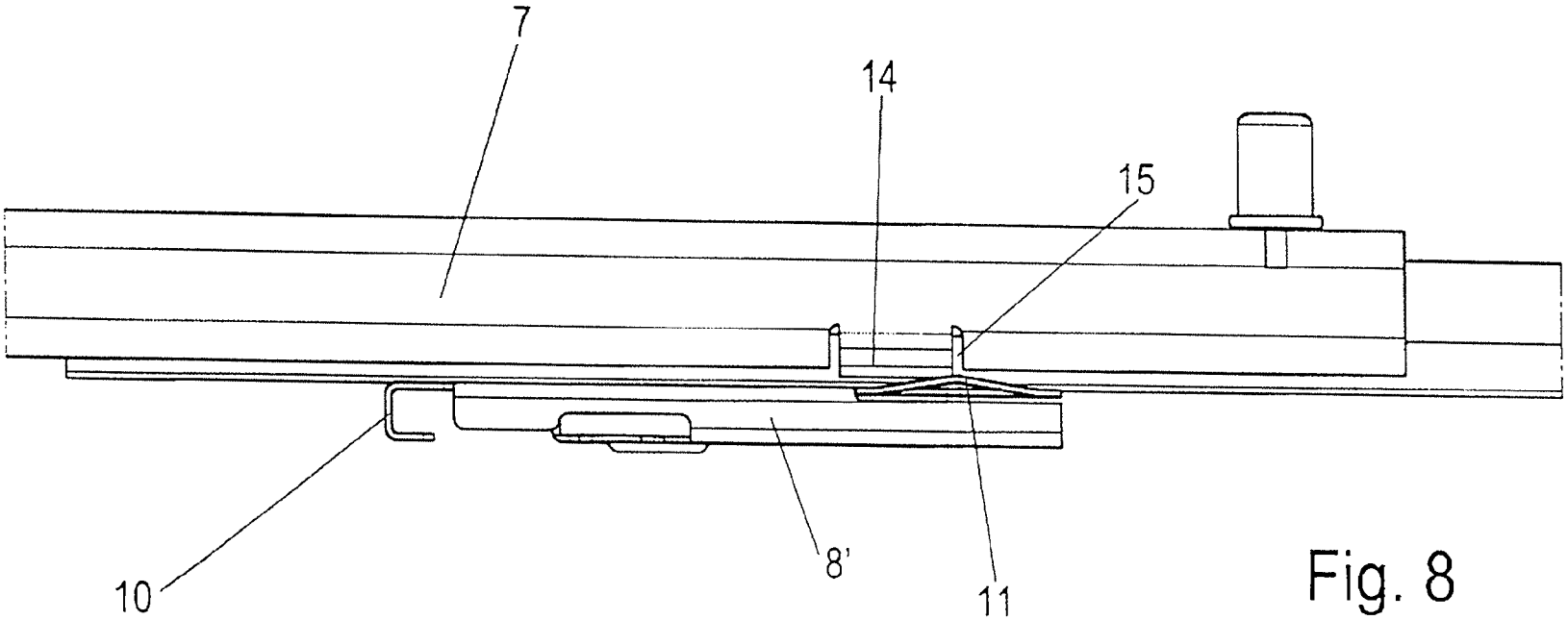
Figure 9:
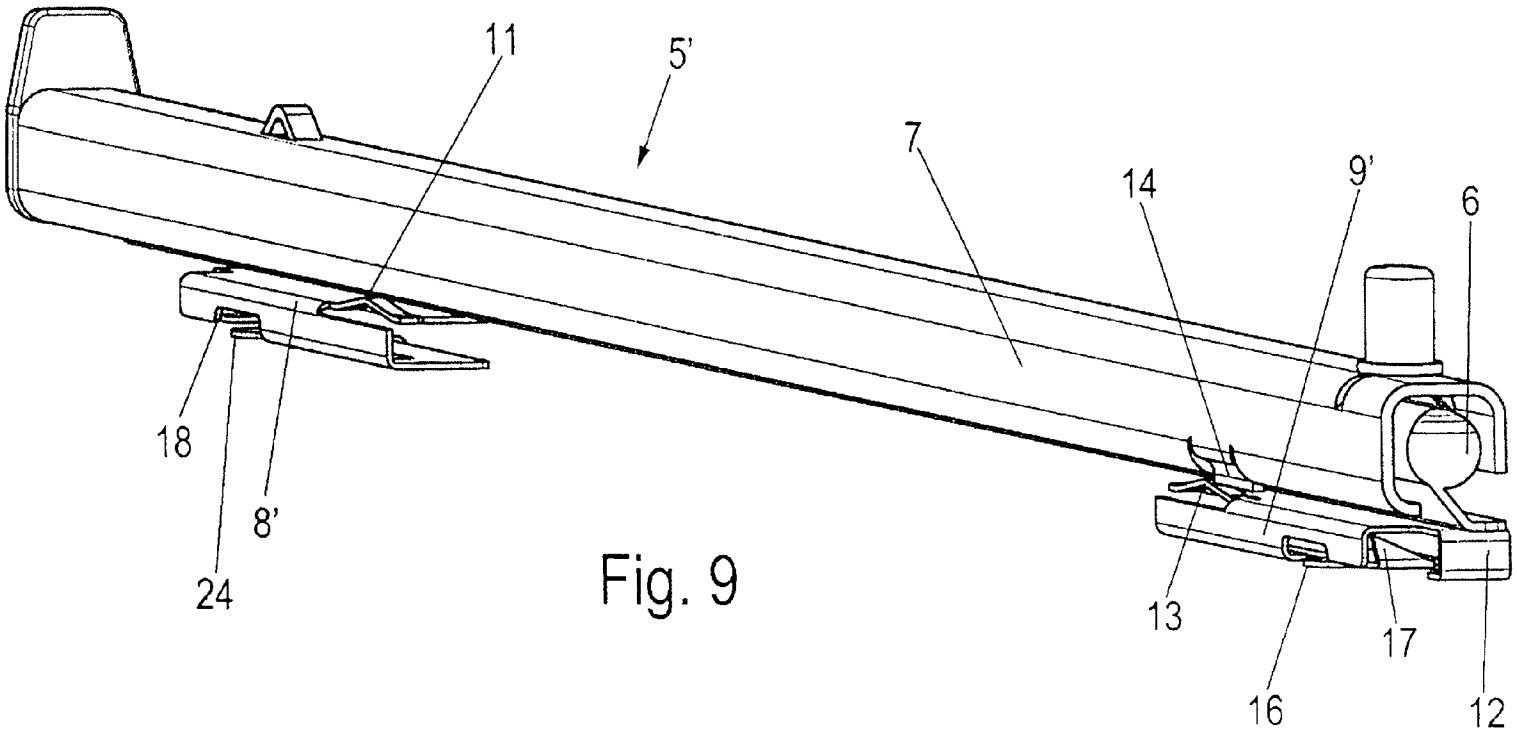

A pull-out device includes a side grid 1 which can, for example, be fixed on a side wall of, for example, a baking oven. Other applications of the pull-out device according to the present disclosure, for example, may be for kitchen appliances or furniture.

The side grid 1 includes two spaced-apart vertical posts 2 between which a plurality of horizontal rods 3 are provided. Each horizontal rod 3 includes bent end sections 4 on opposite sides, which are fixed on a vertical post 2.

One pull-out guide 5 is fixed on each of one or more horizontal rods 3, which pull-out guide includes a stationary guide rail 6 and at least one sliding rail 7 mounted movably thereon. Only one sliding rail 7 may be provided as a partial pull-out whereas an additional middle rail may be disposed between sliding rail 7 and guide rail 6 as complete pull-out or as over pull-out.

A rear fastening element 8 is provided for fixing the pull-out guide 5 by which the guide rail 6 is fixed on a rod 3 on the bent end section 4. A front fastening element 9 is provided in the front area which brings about a fixing on the bent end section 4 on the same rod 3. FIGS. 1 to 4 show an element in the form of a locking projection 19 as locking means, which protrudes from the sliding rail 7 of pull-out guide 5 in the direction of the vertical post 2 of the side grid 1 in order to produce a frictional contact between the respective vertical post 2 and the sliding rail 7 in locking regions.

As shown in FIGS. 5 to 10, a fastening element 8' has a U-shaped clamp 10 by which a bent end section 4 of rod 3 is encompassed. The fastening element 8' also has a V-shaped bent web 11 on the side facing upwards, which is configured to be bendable and disposed adjacent to the sliding rail 7.

The front fastening element 9' includes a U-shaped clamp section 12 by which bent end section 4 is encompassed. A V-shaped web 13 is also configured to be bendable on the upper side of the fastening element 9' which cooperates in engagement with a projection 14 projecting downwards from the guide rail 7. The projection 14 is separated from a neighbouring region of the sliding rail 7 via vertical slots 15.

The resilient webs 11 and 13 on the fastening elements 8' and 9' are disposed such that the movable sliding rail 7 is engaged in a retracted position on the fastening element 9' and in an extended position on the fastening element 8'. During withdrawal, the downwardly directed projection 14 on the sliding rail 7 presses the V-shaped web 13 downwards and runs over this so that for a movement in the direction of extension, first the locking force of the resilient web 13 must be overcome. Then, the sliding rail 7 can be freely extended until the projection 14 disposed on the sliding rail 7 moves over the bent web 11 and consequently engages the sliding rail 7 in the extended position. In the same way, during retraction the projection 14 first passes over the resilient web 11 and then the V-shaped web 13 which is thereby bent downwards so that the sliding rail 7 is engaged on the V-shaped web 13 in the retracted position.

The fastening elements 8' and 9' are thereby pushed onto rod 3 in the horizontal direction, whereby both the U-shaped clamps 10 and 12 and also locking elements 17, 18 serve to fix the fastening elements 8' and 9', which elements grip behind rod 3 in the mounted position and secure the fastening elements 8' and 9' against pulling out. The fastening elements 8' and 9' are thereby formed from a bent and stamped metal sheet so that the fastening means for fixing on rod 3 and also the resilient webs 11 and 13 are configured integrally.

As can be identified from FIGS. 11 and 12, the strip-shaped fastening element 8' includes a grip section 24 for movement of an inner projection 18 so that the fastening element 8' can be mounted and dismounted in a simple manner. In the same way, the fastening element 9' includes an integrally formed grip section 16 for movement of the projection 17.

Figure 13:
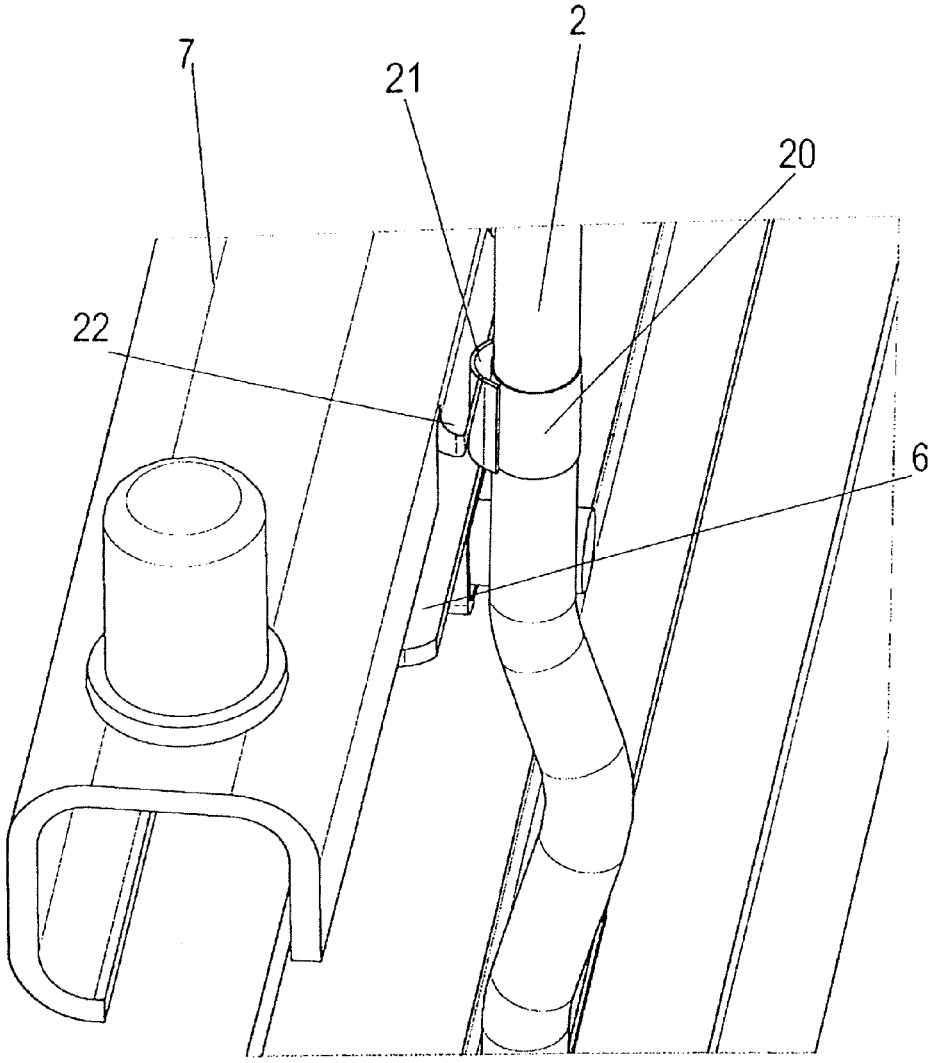
FIGS. 13 to 15 show several views of an embodiment of a modified pull-out device for engaging a sliding rail, in accordance with the present disclosure.
Figure 14:
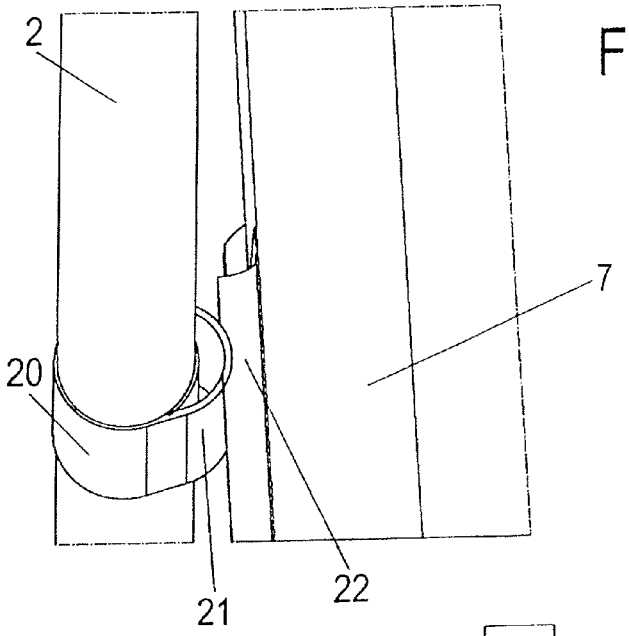
Figure 15:
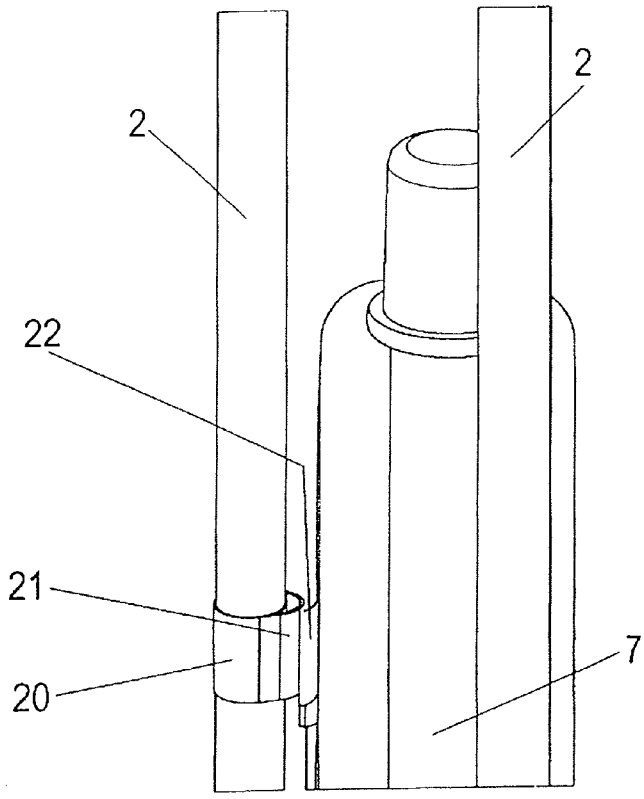
Figure 16:
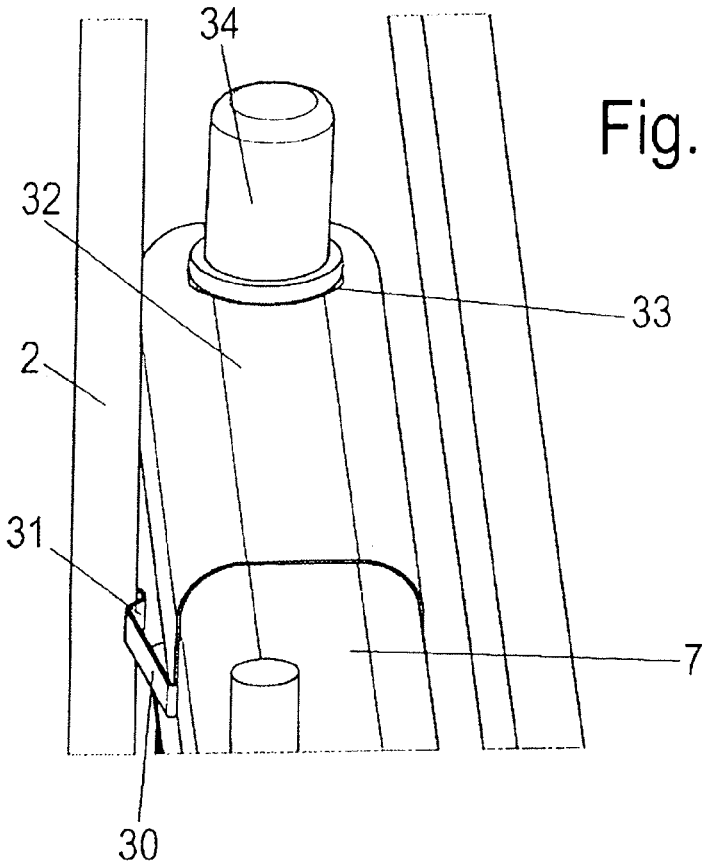
FIGS. 16 to 18 show views of another embodiment of a pull-out device, according to the present disclosure.
Figure 17:
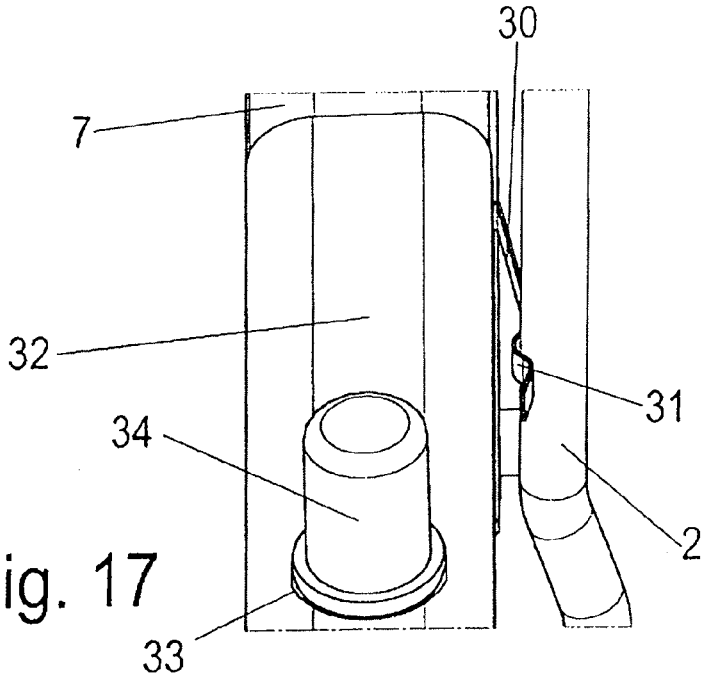
Figure 18:
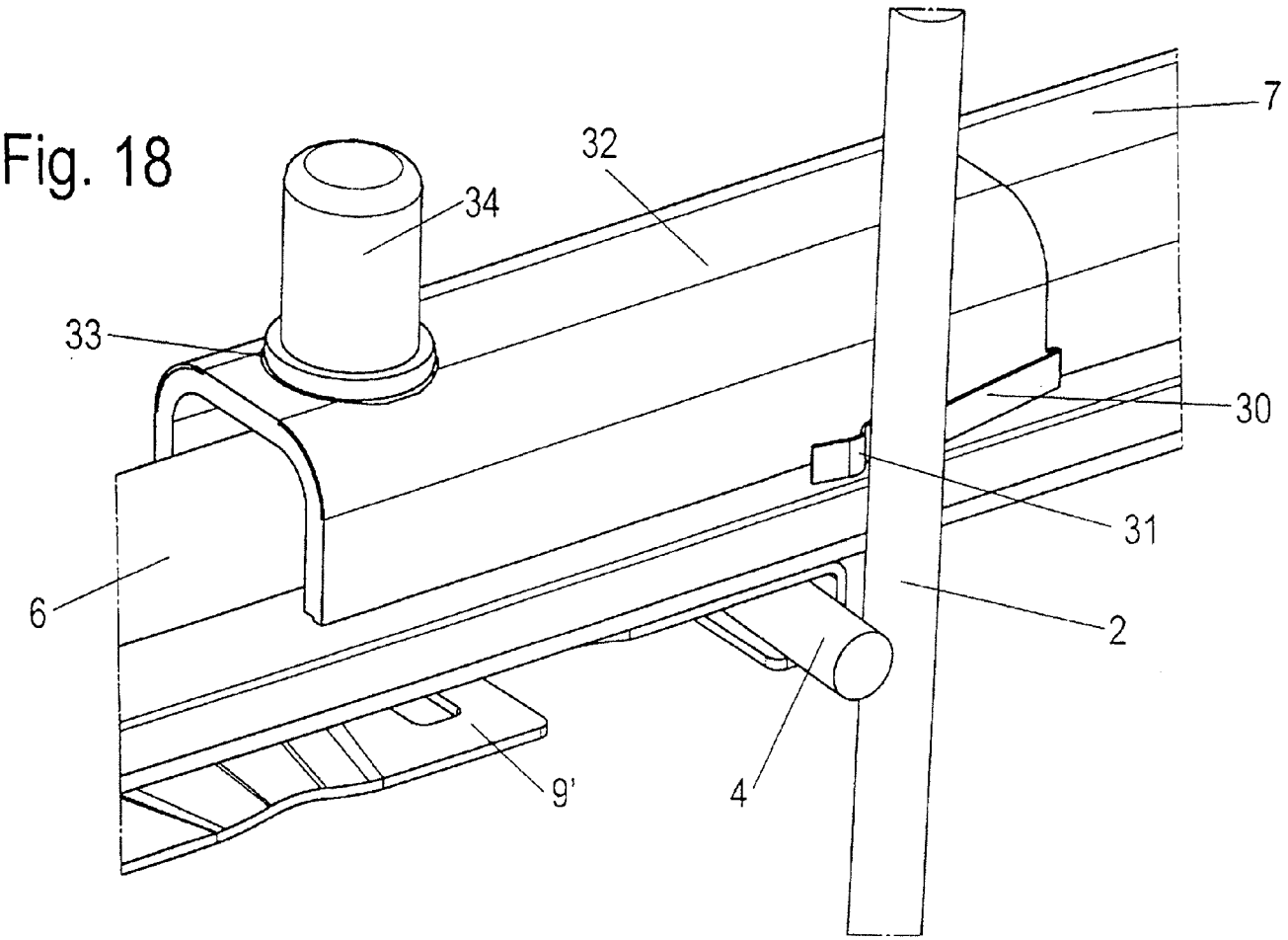
Figure 19:
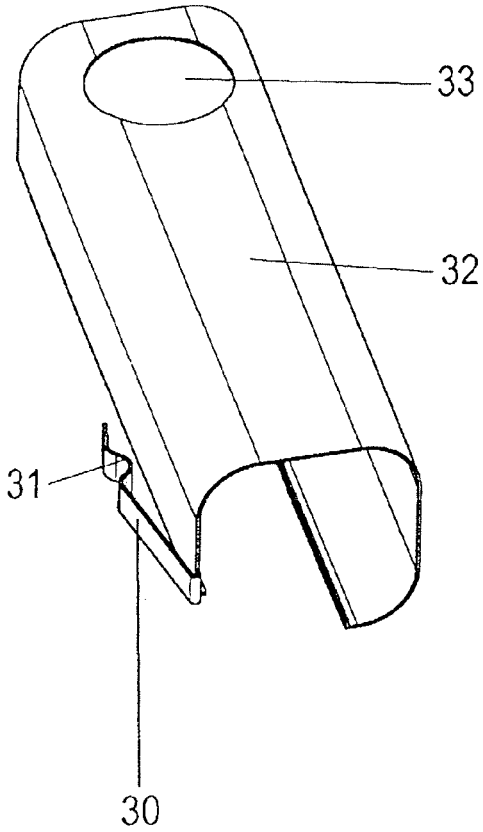
FIGS. 19 and 20 show two views of a clip of the pull-out device of FIGS. 16 to 18.
Figure 20:
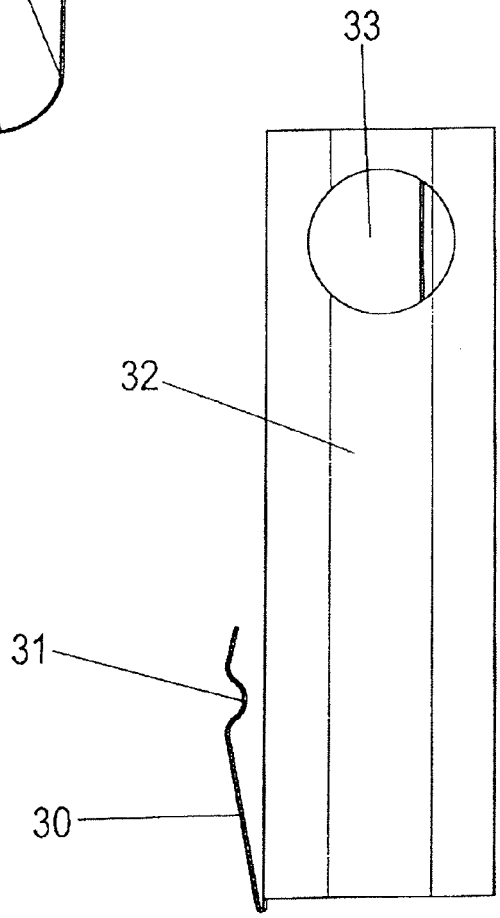

FIGS. 13 to 15 show a modified embodiment of a pull-out device in which vertical posts 2 are provided on a side grid 1 on which clips 20 are formed with a bent resilient web 21. The resilient web 21 projects from the post 2 on the side facing the sliding rail 7 and can enter into engagement with a projection 22 formed on the sliding rail 7. As a result, the sliding rail 7 can press against the post 2 when passing over the resilient web 21 and then engage behind the resilient web 21. Corresponding clips 20 can, for example, be provided both on the front post 2 and on the rear post 2 so that the sliding rail 7 can be engaged in a retracted position and in an extended position.

FIGS. 16 to 20 show a modified embodiment of a pull-out device in which a cover 32 is mounted on the sliding rail 7 at the end. A resilient web 30 is formed integrally with the cover 32, which projects on the side of the side grid 1 and has a locking recess 31. The cover 32 is initially mounted at the end on the sliding rail 7 where a stop pin 34, which passes through the cover 32 at an opening 33, is used for axial securing. The cover 32 is configured to be U-shaped and can be engaged on the sliding rail 7. The resilient web 30 is formed on the cover 32 such that the locking recess 31 can engage both on the front post 2 and on the rear post 2 when the corresponding retracted or extended position of the sliding rail 7 is reached.

Figure 21:
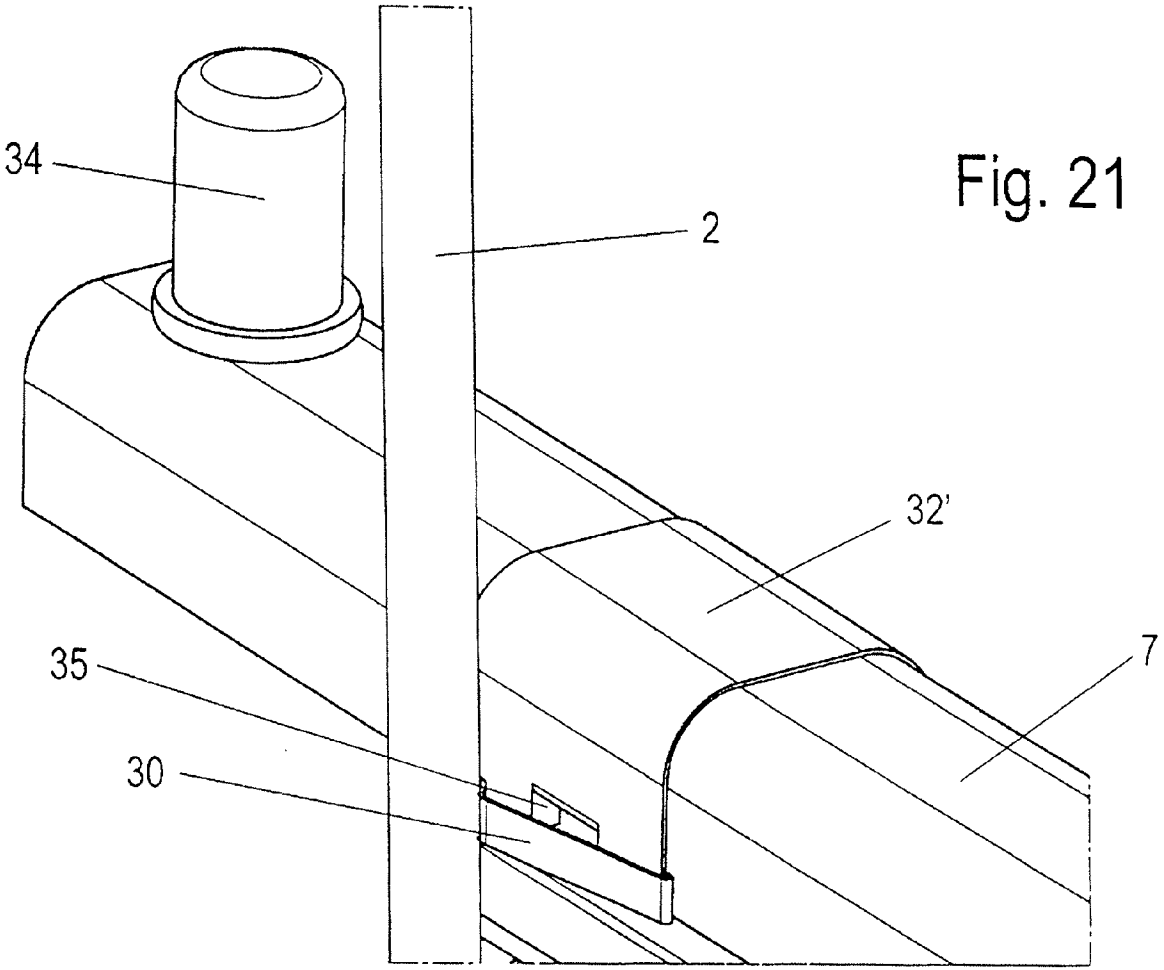
FIG. 21 shows a perspective view of a modified embodiment of a pull-out device, according to the present disclosure.

FIGS. 21 and 22 show a modified embodiment of a cover 32' compared with FIGS. 16 to 20, which is not mounted on the stop pin 34 at the end on the sliding rail 7 but in a central region. In order to secure the cover 32' in the axial direction, an inwardly directed web 35 is formed on the cover 32' on one side, which engages in a corresponding recess or an embossing on the sliding rail 7. Here also the cover 32' is configured to be U-shaped and can be engaged on the sliding rail 7. A projecting web 30, on which a locking recess 31 is provided, is formed on the side of the side grid 1 integrally with the cover 32'. The locking recess 31 is used to receive a vertical post 2, where the sliding rail 7 can be engaged both on a front vertical post 2 and also on a rear vertical post 2.

Figure 24:
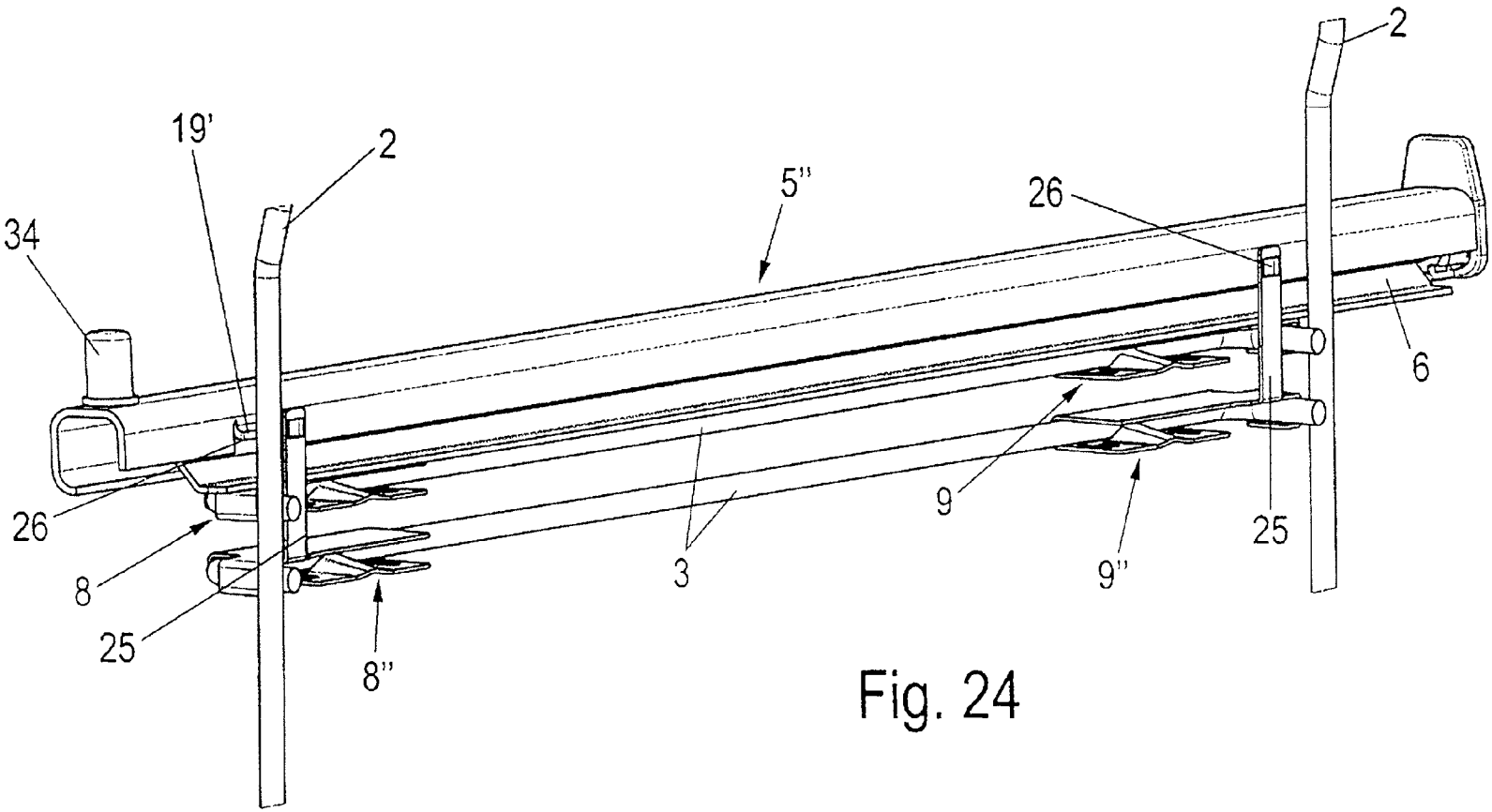
FIGS. 24 to 26 show two views of a another embodiment of a pull-out device, according to the present disclosure.
Figure 25:
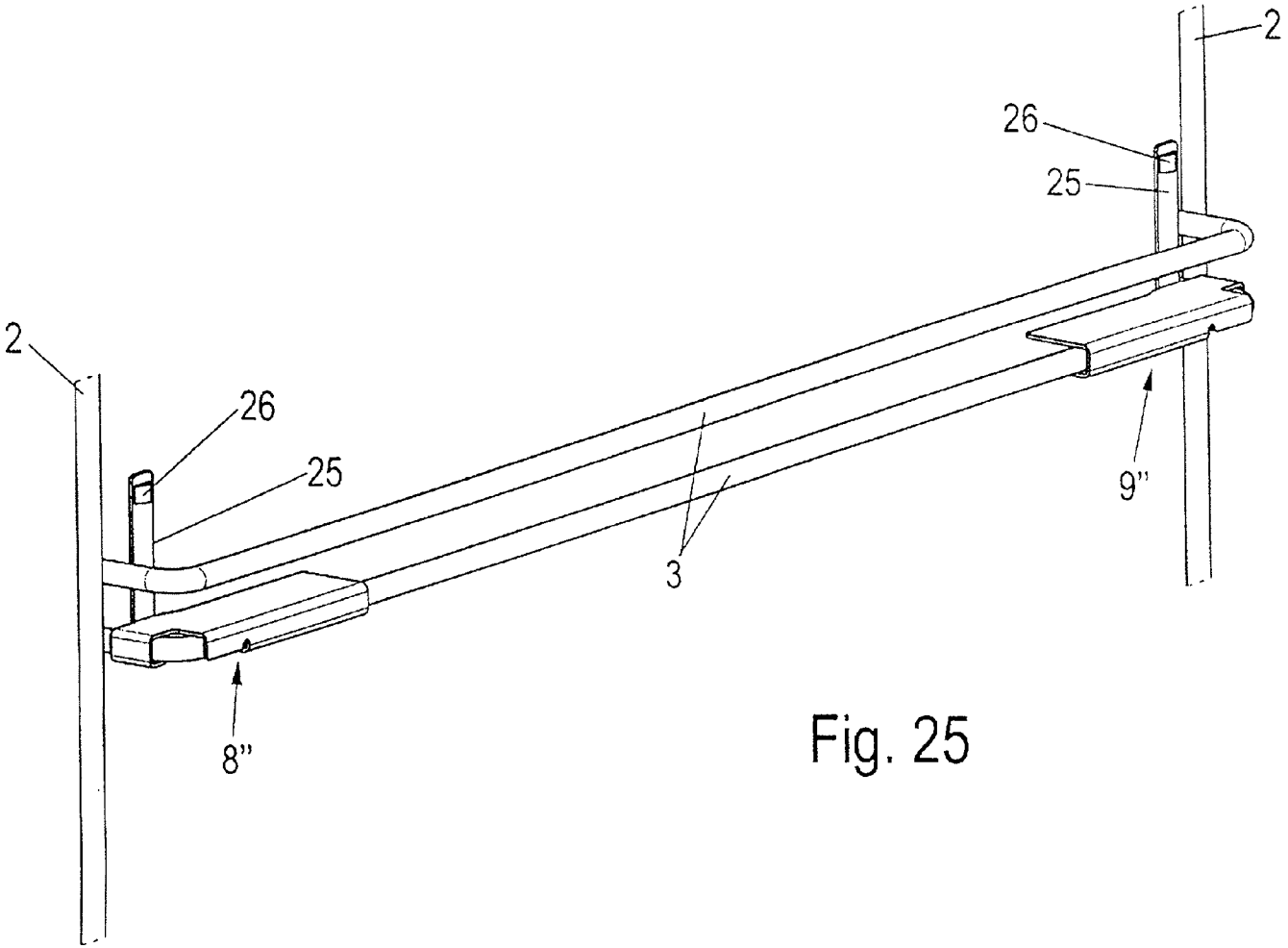
Figure 26:
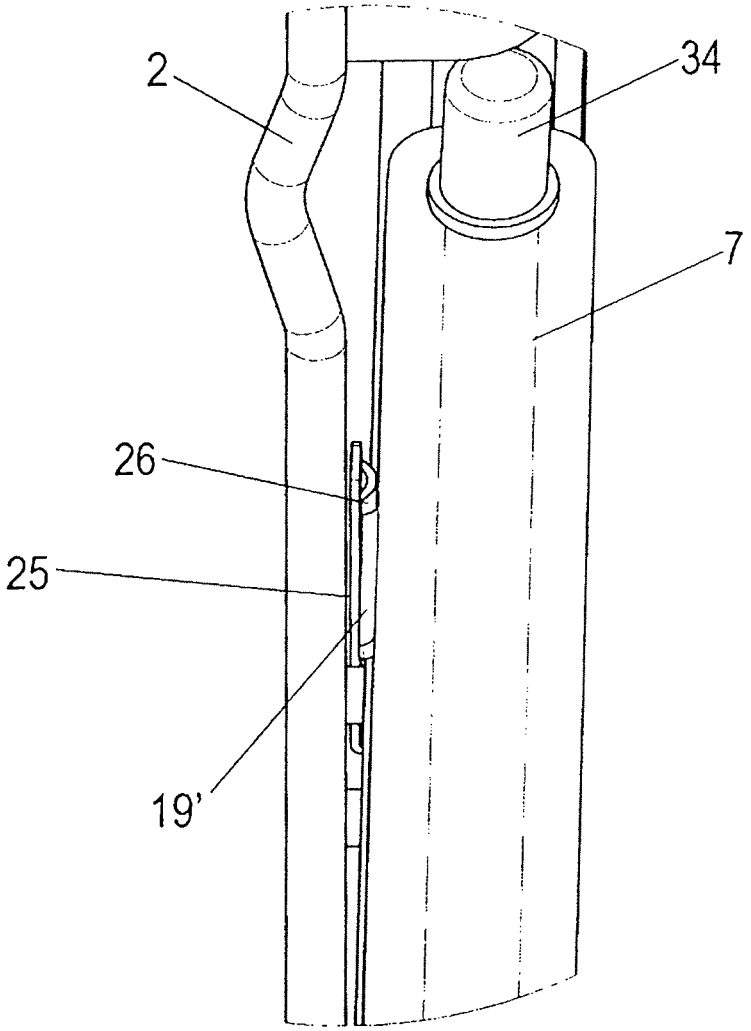

In FIGS. 24 to 26 a resilient web in the form of a locking element 26 is fixed on a parallel-offset horizontal web 3 via a fastening element 8", 9". A locking projection 19' that cooperates with the locking element 26 is located on the sliding rail 7 of a pull-out guide 5".

Figure 27:
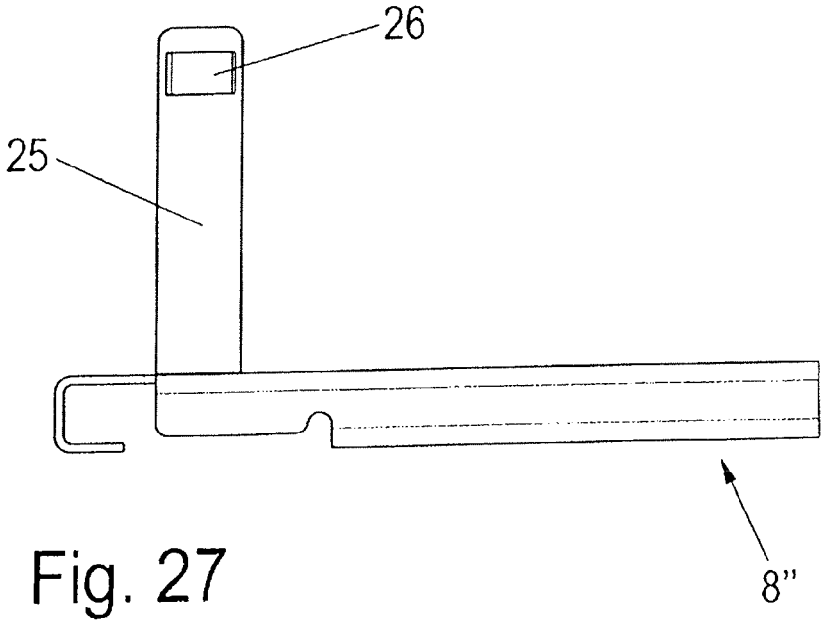
FIGS. 27 and 28 show two views of a clip of the pull-out device of FIG. 24.
Figure 28:
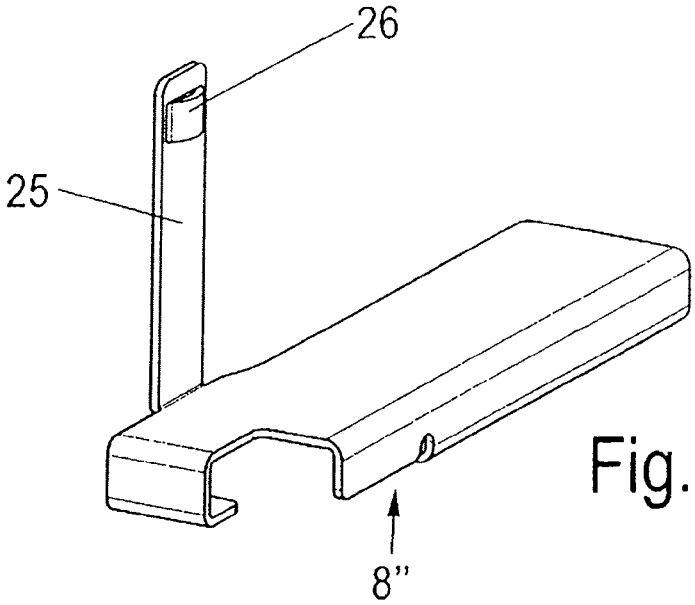

FIGS. 27 and 28 show the rear fastening element 8" on which a perpendicular element 25 accommodating the locking element 26 is disposed. The front fastening element 9" is constructed as a mirror image to the rear fastening element 8".

Figure 29:
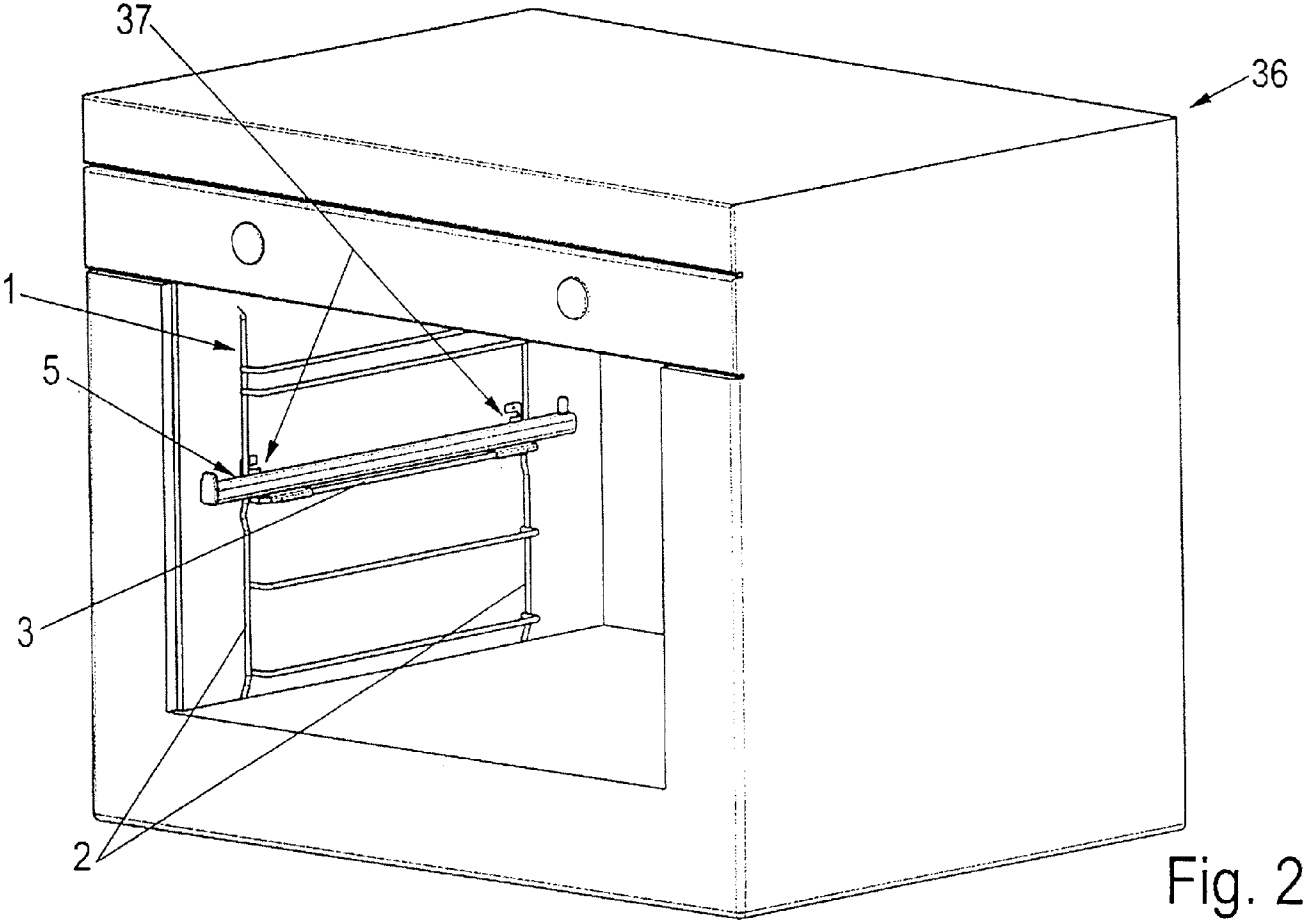
FIG. 29 shows a view of a household appliance with an embodiment of the pull-out device, according to the present disclosure.
Figure 30:
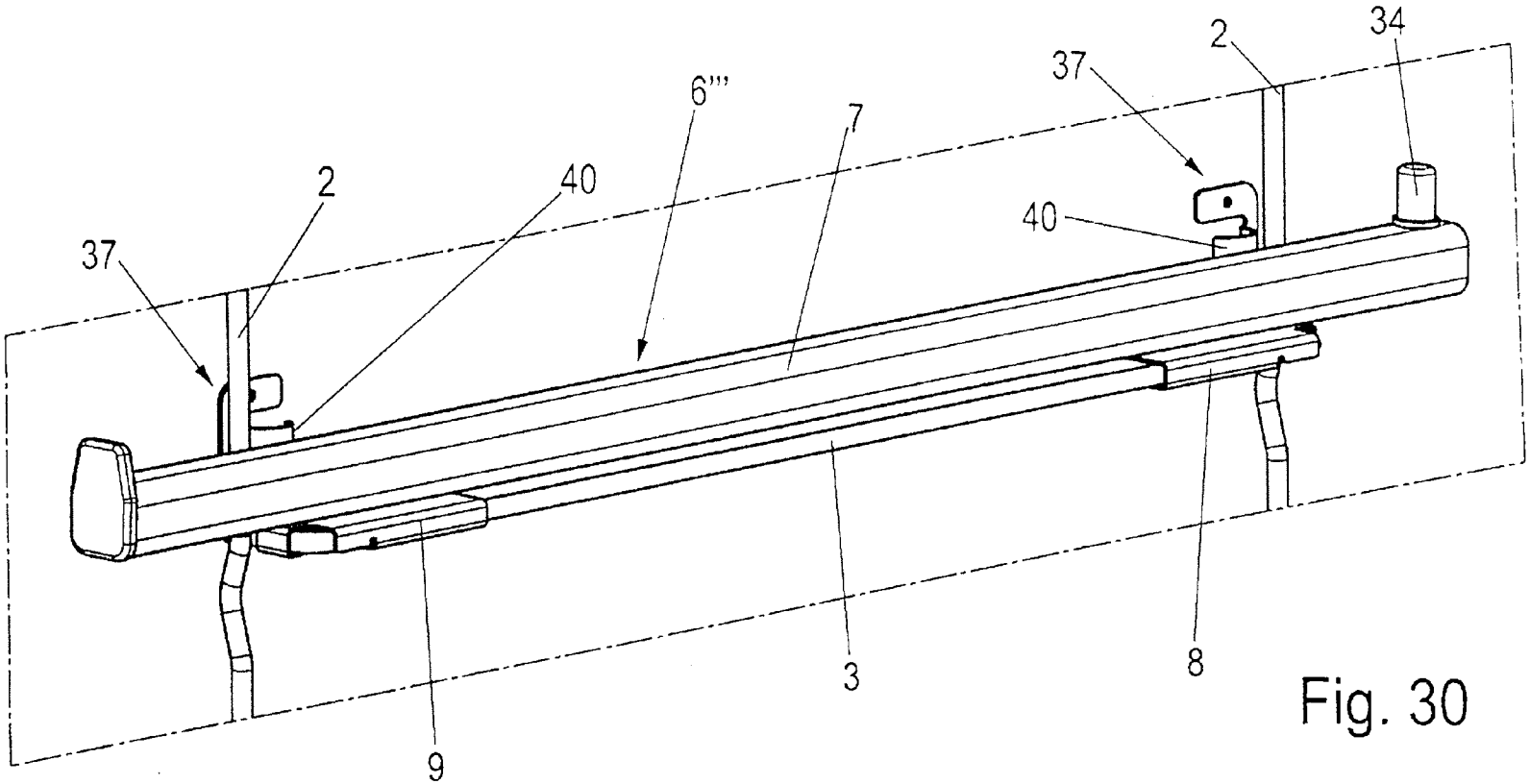
FIG. 30 shows a view of the embodiment of the pull-out device according to FIG. 29.

In FIGS. 29 and 30 a resilient web in the form of a resilient section 40 as part of a locking element 37 is fixed in the front and rear area of a wall 39 of a household appliance 36 or furniture. A locking projection 19" which cooperates with the resilient section 40 is located on the sliding rail 7 of a pull-out guide 5'".

Figure 31:
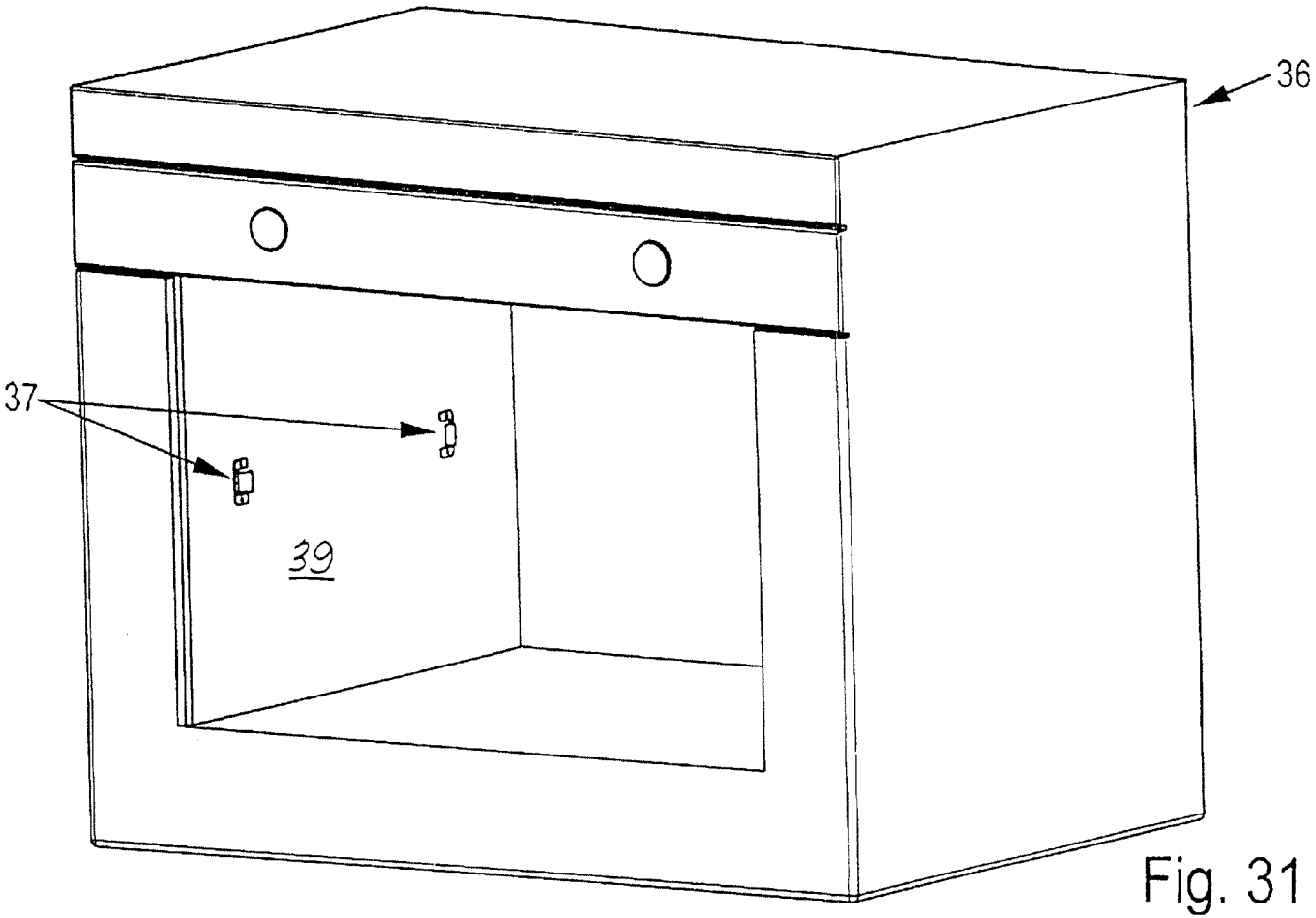
FIG. 31 shows a household appliance having locking means for a pull-out device, according to the embodiment of FIG. 29.

FIG. 31 shows the mounted locking elements 37 on the wall 39 of the household appliance 36.

Figure 32:
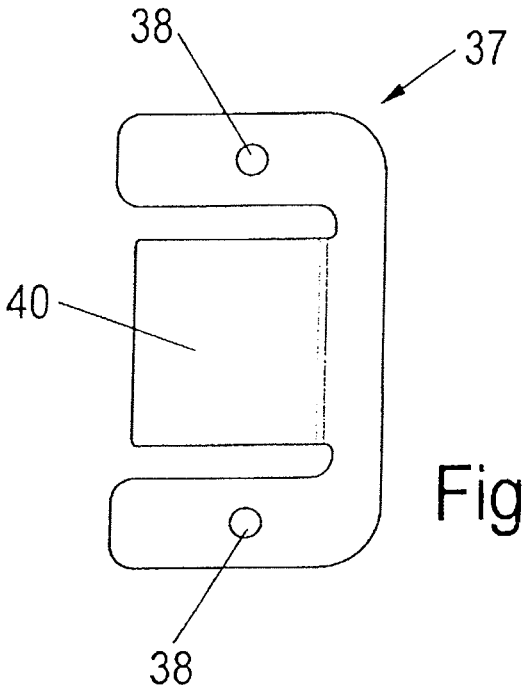
FIGS. 32 and 33 show locking means for a pull-out device according to the embodiment of FIG. 29.
Figure 33:
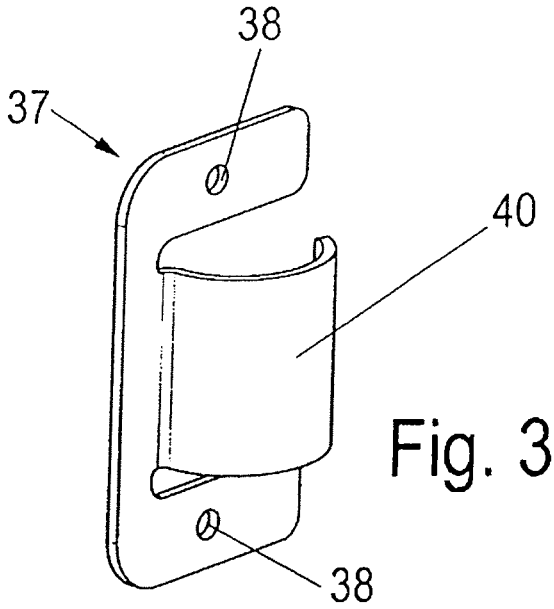

FIGS. 32 and 33 show a front view (see FIG. 33) and a rear view (see FIG. 32) of the locking element 37. The resilient section 40 and the fastening openings 38 are shown. The locking element 37 is designed as an identical part for front and rear use, in accordance with the present disclosure.

Figure 34:
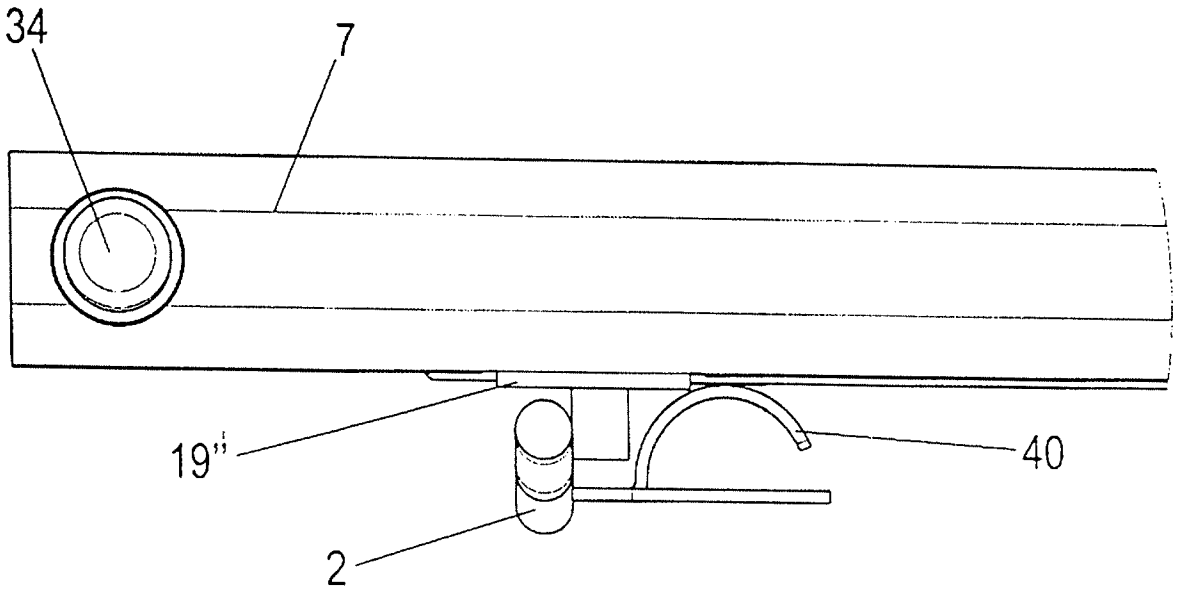
FIGS. 34 and 35 shows two views of an arrangement of the locking means for the pull-out device according to the embodiment of FIG. 29.
Figure 35:
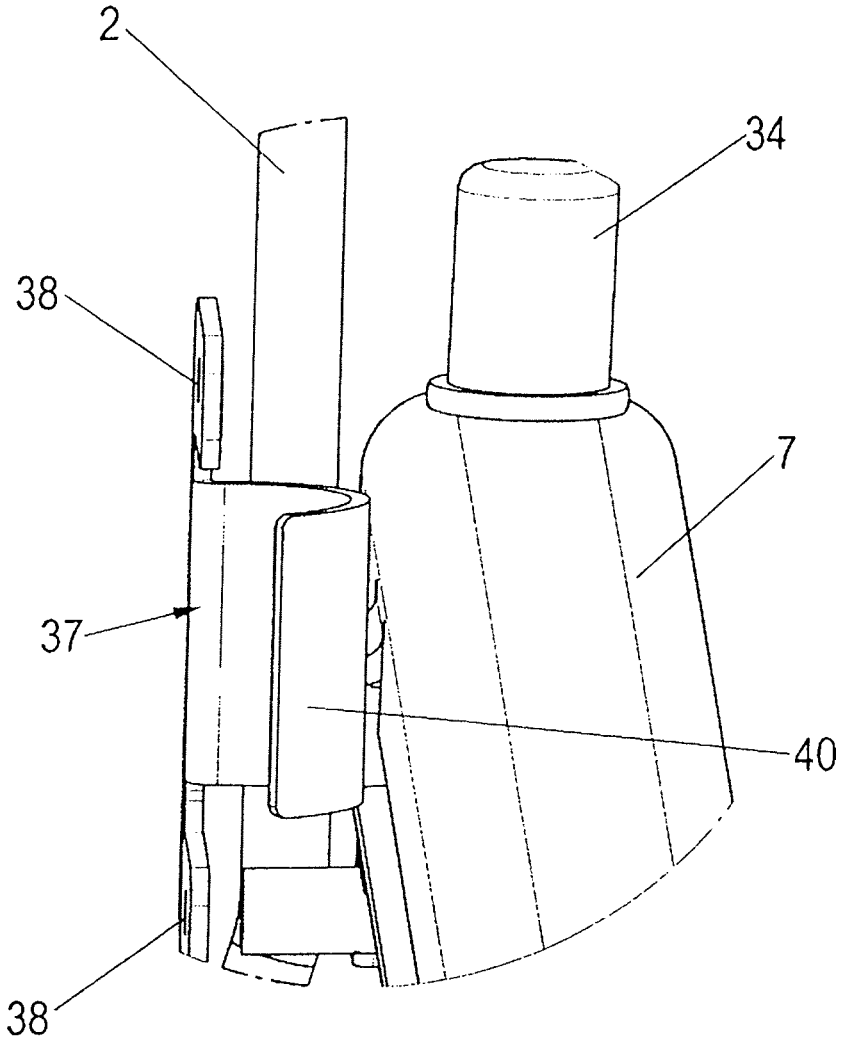

FIGS. 34 and 35 show the arrangement of the locking element 37 in relation to the locking projection 19" on the sliding rail 7 of a pull-out guide 5'".

It is within the scope of the present disclosure to provide other locking means for fixing the sliding rail 7 in an extended or a retracted position. The locking forces are determined so that an unintentional movement of the sliding rail 7 in the event of a slight inclination of the pull-out guide 5, 5', 5", 5'" is avoided and a treatment, for example, on a food tray is possible. After releasing the engagement, the sliding rail 7 can be moved smoothly with respect to the guide rail 6.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A pull-out device for a household appliance, the pull-out device comprising:

a side grid configured to be installed in an interior space of the household appliance;

a plurality of horizontal rods each having a bent end section on opposite sides of the rod, the bent end sections being fixed on a vertical post of the side grid;

a guide rail fixed on at least one of the rods by a fastening element; and a resilient v-shaped web configured to detachably fix a sliding rail that is movably supported on the guide rail in one or both of a retracted and an extended position.

2. The pull-out device according to claim 1, wherein the resilient web is fixed on the sliding rail and, during a movement of the sliding rail, the resilient web is configured to be engaged both with a front vertical post and with a rear vertical post of the side grid.

3. The pull-out device according to claim 1, wherein the resilient web is configured integrally with the sliding rail.

4. The pull-out device according to claim 1, wherein the resilient web is fixed on the sliding rail by a clip.

5. The pull-out device according to claim 1, wherein the resilient web is formed integrally with one of the fastening elements and cooperates with one or more of a projection, a profiling and a recess on the sliding rail.

6. The pull-out device according to claim 1, wherein the resilient web is fixed on the vertical post.

7. The pull-out device according to claim 1, wherein the locking means includes a locking element that is fixed on a horizontal rod by the fastening elements.

8. The pull-out device according to claim 1, wherein the locking means includes a locking element that is fixed on a wall of the household appliance.

9. A pull-out device for a household appliance, the pull-out device comprising:

a side grid configured to be installed in an interior space of the household appliance;

a plurality of horizontal rods each having a bent end section on opposite sides of the rod, the bent end sections being fixed on a vertical post of the side grid;

a guide rail fixed on at least one of the rods by a fastening element; and locking means configured to detachably fix a sliding rail that is movably supported on the guide rail in one or both of a retracted and an extended position, the locking means including a resilient web, wherein the resilient web is fixed on the sliding rail and, during a movement of the sliding rail, the resilient web is configured to be engaged both with a front vertical post and with a rear vertical post of the side grid.

10. The pull-out device of claim 9 wherein the resilient web is v-shaped.

11. The pull-out device of claim 9 wherein the resilient web is formed from a bent metal sheet.

12. The pull-out device of claim 9 attached to the side-grid of a baking oven.

13. A pull-out device for a household appliance, the pull-out device comprising:

a side grid configured to be installed in an interior space of the household appliance;

a plurality of horizontal rods each having a bent end section on opposite sides of the rod, the bent end sections being fixed on a vertical post of the side grid;

a guide rail fixed on at least one of the rods by a fastening element;

locking means configured to detachably fix a sliding rail that is movably supported on the guide rail in one or both of a retracted and an extended position, the locking means including a resilient web configured integrally with the sliding rail.

14. The pull-out device of claim 13 wherein the resilient web is v-shaped.

15. The pull-out device of claim 13 wherein the resilient web is formed from a bent metal sheet.

16. The pull-out device of claim 13 attached to the side-grid of a baking oven.

17. A pull-out device for a household appliance, the pull-out device comprising:

a side grid configured to be installed in an interior space of the household appliance;

a plurality of horizontal rods each having a bent end section on opposite sides of the rod, the bent end sections being fixed on a vertical post of the side grid;

a guide rail fixed on at least one of the rods by a fastening element;

locking means configured to detachably fix a sliding rail that is movably supported on the guide rail in one or both of a retracted and an extended position, the locking means including a resilient web, wherein the resilient web is formed integrally with one of the fastening elements and cooperates with one or more of a projection, a profiling and a recess on the sliding rail.

18. The pull-out device of claim 17 wherein the resilient web is v-shaped.

19. The pull-out device of claim 17 wherein the resilient web is formed from a bent metal sheet.

20. The pull-out device of claim 17 attached to the side-grid of a baking oven.

* * * * *